United States Patent [19]

Chlystun

[11] Patent Number: 4,893,734

[45] Date of Patent: Jan. 16, 1990

[54] RESEALABLE CLOSURE AND CONTAINER EMPLOYING SAME

[76] Inventor: Walter K. Chlystun, 327 St. James Dr., Spartanburg, S.C. 29302

[21] Appl. No.: 235,541

[22] Filed: Aug. 24, 1988

[51] Int. Cl.[4] ..... B67B 5/00

[52] U.S. Cl. ..... 222/153; 222/143; 222/498; 222/529; 222/530; 222/531; 222/539; 222/545; 222/556; 222/562; 222/572; 215/216

[58] Field of Search ..... 222/143, 147, 153, 206, 222/498, 517, 529, 530, 531, 532, 538, 539, 545, 556, 562, 568, 525; 215/329, 330, 216, 224; 220/367

[56] References Cited

U.S. PATENT DOCUMENTS

| | | | |
|---|---|---|---|
| 3,227,332 | 1/1966 | Gowdy et al. | 222/525 |
| 3,954,200 | 5/1976 | Willis | 215/216 |
| 4,327,842 | 5/1982 | Walter | 220/367 |
| 4,533,058 | 8/1985 | Uhlig | 215/216 |
| 4,602,728 | 7/1986 | Ha | 222/530 X |
| 4,718,567 | 1/1988 | La Vange | 215/216 |

*Primary Examiner*—Joseph J. Rolla
*Assistant Examiner*—Boris Milef
*Attorney, Agent, or Firm*—Dority & Manning

[57] ABSTRACT

An improved dispensing container which includes side walls, a top wall, a dispensing spout and a closure removably securable to the spout. The closure includes a skirt portion adapted for removable securement to the spout, and with a cap hingedly secured thereto. The cap and a portion of the skirt have matable elements which in mating relationship releasably secure the cap in a closed position. The cap further includes a locking member which is matable with a member on the spout when the cap is in the closed position to preclude removal of the closure from the spout. In one embodiment, the closure further includes a top wall which defines an opening therein which serves to vent the container and at the same time permits squirt-type dispensing of the contents of the container. In such embodiment, the cap when closed closes the top wall opening. The closure is also claimed.

25 Claims, 5 Drawing Sheets

RESEALABLE CLOSURE AND CONTAINER EMPLOYING SAME

BACKGROUND OF THE INVENTION

The present invention relates to an improved resealable closure for use in conjunction with a container, preferably a container with an integral, collapsible pouring spout, and to a container employing such improved resealable closure.

Previous development of the container art, at least insofar as containers for the packaging of various and sundry liquids, has progressed in the direction of providing containers with self-opening means. Further, certain of these containers are adapted with pouring spouts that are affixed to the container in some fashion to facilitate the dispensing of the contents from the container. Moreover, containers are now known with a combined opening means and pouring spout, whereby upon lifting or disengaging the opening means from the top of the container, a pouring spout secured to the underside thereof or located therebeneath is withdrawn from a nested position within the container. Various opening means have been taught including screw caps, integral cover caps which must be cut or torn away from the spout and the like.

Moreover, many of these caps or closures are provided with unitary pull tabs or bails for use in withdrawing the spout from within the body of the container. Likewise, certain of the closures have the capability of reclosing only or of resealing the container after first being removed or opened.

Containers such as mentioned above are intended for use in storing and dispensing of oil, hazardous chemicals, fuels, and other household and industrial compositions. As such, an independent opener and/or spout is no longer required for use with the type of containers previously described. Moreover, while certainly these prior art containers are an advance in the art, further improvement is still possible. For example, once a container containing a fluid is closed, with a threaded opening means, inadvertent unscrewing of the cap from the spout can cause a container to leak.

All-in-all, with a container having a built-in or integral pouring spout, many advantages are present. With such a container, however, it is important that same be capable of convenient withdrawal of the spout, dispensing of the contents and resealing of the container if less than the full contents are to be dispensed. The present invention affords such a construction.

The present invention has thus further improved the container art by providing a container having a collapsible pouring spout that nests within the container and may be withdrawn from within the container to a pouring position, and with a resealing closure that cannot be removed when the closure is in the closed position. The closure of the present invention has integral therewith a friction or otherwise engaging hinged cap, whereby if only a portion of the contents are needed and can be dispensed without removal of the closure, the pouring spout can be accessed for dispensing and thereafter can be tightly reclosed or resealed and the contents saved for future use. In fact, the reclosable cover of the present invention even permits recollapse of the pouring spout to its original nested position. Furthermore, teeth or other stop means disposed on the spout engage a pawl or other means disposed on a portion of the cap when the hinged cap is closed, and prevents undesired rotation of the cover relative to the spout thereby preventing the cover from inadvertently being removed from the spout.

Insofar as the present closure is concerned, in one embodiment, a vent opening may be defined in a top wall of same, to be closed when the cap is closed. When the cap is open, the closure remains in place and functions as a "squirt" closure. Likewise, when the cap is open, the closure can be unscrewed or otherwise removed from the spout, whereupon contents from the container may be poured from the spout.

Known prior art deemed relevant to the present invention includes the following listed U.S. Pat. Nos. 3,856,187; D-240,314; 4,027,811; 4,082,827; 4,066,190; 4,095,728; 4,139,129; 4,529,108; 4,576,565 and 4,619,797, none of which teaches or suggests the present invention. Also as to closures per se, prior art closures are known which are threadably attached to a container and include a dispensing opening in a top wall and a cap integrally hinged to the closure. When the cap is open, contents may be squirted or otherwise expelled through the dispensing opening. Again, such prior art does not teach or suggest the present invention.

SUMMARY OF THE INVENTION

It is an object of the present invention to provide an improved container having an integral pouring spout.

Another object of the present invention is to provide a container having a collapsible pouring spout capable of nesting therein and having a resealable closure associated therewith which cannot be inadvertently removed from the container when the closure is closed.

Still another object of the present invention is to provide a container having a pouring spout with a removable, reclosable closure secured thereto which is prevented from inadvertent removal from the spout.

Yet another object of the present invention is to provide an improved closure for a container.

Still further another object of the present invention is to provide an improved resealable closure for a container which can be used for limited dispensing or which can be removed for more rapid dispensing of contents from the container, and which is precluded from inadvertent removal from a container.

Generally speaking, the present invention relates to a container for packaging and dispensing products and includes side walls, a top wall secured to said side walls, a pouring spout secured to said top wall and providing access to the interior of the container therethrough, and a closure removably secured to said pouring spout, said closure including a top wall defining a vent opening therein and a skirt portion secured thereto and depending downwardly therefrom for removable securement to said spout, said closure further including a cap hinged thereto and being movable about said hinge between an open and a closed position, said cap having means thereon that mate with a portion of said closure for releasable securement in the closed position and having further means thereon that mate with a portion of said spout when in the closed position to lock said closure onto said spout.

More specifically, the container of the present invention is useful for packaging and dispensing liquids such as oil, chemicals and the like. The container in a preferred embodiment is self-contained, in that, a combined closure and opening means is threadably secured to a pouring spout which, when lifted, pulls the spout from a nested position within the container to an extended dispensing position. Further, the closure means includes a vented top wall with a hinged cap which is movable about its hinge connection between an open position and a closed position where a portion of the cap interrelates with a portion of the closure to releasably secure the cap in the closed position. The cap also preferably includes a finger receiving opening to be engaged for withdrawal of the spout, and means to seal the vent opening in the closed position. Also in the closed position, means are provided, preferably a pawl which depends from the cap and engages means on the spout to preclude removal rotation of the closure and thereby lock the closure on the container.

Insofar as construction of the container of the present invention is concerned, the side walls, top wall and pouring spout are preferably molded as a unitary item from known polymeric materials such as polyethylene or polypropylene. The top and pouring spout may, however, be molded separately from the side walls and affixed thereto. Likewise, the pouring spout may be manufactured separately and secured to the top wall in an opening therein.

Generally speaking, the closure according to the present invention includes a skirt portion having means on an inside wall for removable securement to a portion of a container and a cap hingedly secured to said skirt for movement thereabout between an open and a closed position, said cap having means thereon matable with a portion of said closure for releasable securement of said cap in the closed position, said cap further having means thereon matable with a portion of a container with which said closure is to be used when said cap is in the closed position to preclude against removal of said closure from said container so long as said cap is in the closed position.

More particularly, in a preferred embodiment, a top wall is provided which is secured to the skirt and which has an upwardly projecting member with a vent opening therethrough. In such embodiment, the cap has means on an underside of same for closing and sealing the vent opening in the top wall when the cap is closed. Likewise, the cap preferably defines a finger receiving opening which can be engaged when the cap is in the open position for withdrawal of the spout to which the closure is secured for a dispensing position.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
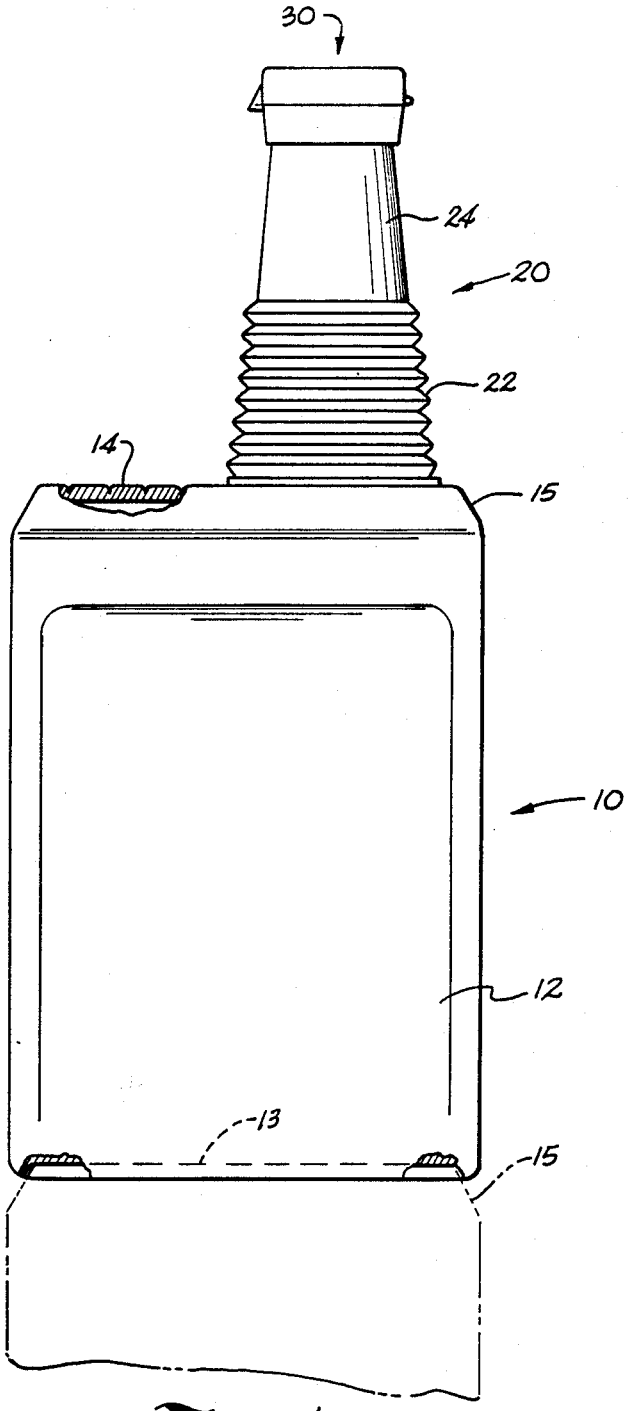
FIG. 1 is a side elevational view of a container according to the present invention, partially broken away.
Figure 2:
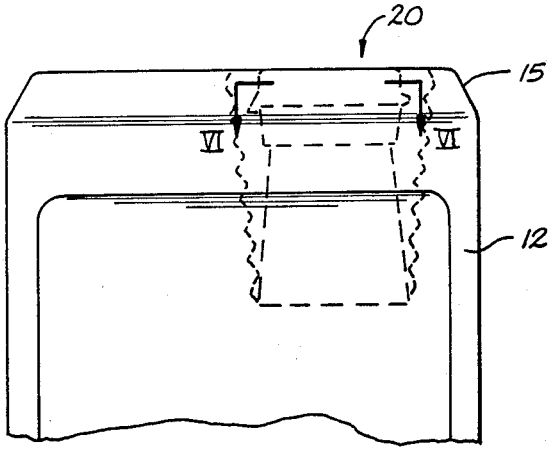
FIG. 2 is a partial side elevation of a container as illustrated in FIG. 1, showing the pouring spout nested within the container.

Referring to the Figures, preferred embodiments of the present invention will now be described. A container generally indicated as 10 having side walls 12 and a top wall 14 is shown in FIGS. 1 and 2. Secured to top wall 14 is a pouring spout generally indicated as 20. Pouring spout 20 may be of unitary construction with top wall 14 as shown in FIGS. 1 and 2 or may be secured to top wall 14 in some other manner. Also, pouring spout 20 according to a preferred embodiment is designed to nest within container 10 (see FIG. 2) and to be extendable to a dispensing position as illustrated in FIG. 1. While preferably container 10 is a quadrilateral (see FIG. 8), container 10 may be round or otherwise as desired.

Looking to FIG. 1, it may be seen that a lower portion of side walls 12 turn in and upwardly to define a recess 13. Further, upper portions 15 of sidewalls 12 are angled inwardly. Hence, with spout 20 nested within container 10 as shown in FIG. 2, a container 10 may have a further container 10 stacked atop same with angled side walls 15 of the bottom container 10 moving into recess 13 of the uppermost container 10 as illustrated in part in FIG. 1.

Pouring spout 20 could be designed to telescope into container 10 instead of flexing in an accordion or some other fashion. For the purposes of this application, the term collapse refers to any movement or compression of a spout 20 into a container 10. As shown in FIG. 1, and as is preferred, pouring spout 20 is made up of a lower flexible bellows or accordion section 22 and an upper rigid section 24 terminating at an outer free end 25. As thus described, pouring spout 20 is collapsible to nest within the container 10 as shown by way of example, in phantom in FIG. 2 wherein upper section 24 extends into everted bellows section 22. A closure generally indicated as 30 is removably secured to upper free end 25 as is more particularly described hereinafter.

Figure 3:
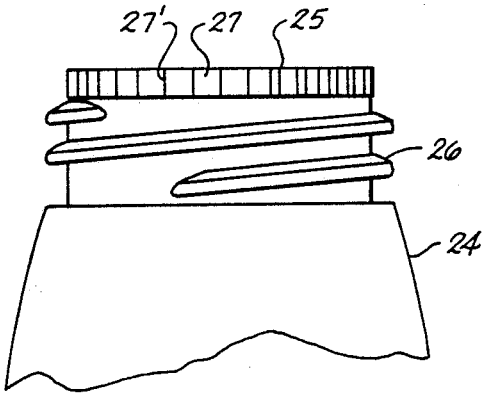
FIG. 3 is an enlarged view of a portion of a container pouring spout according to the present invention.

Upper free end 25 of pouring spout 20, as shown in FIG. 3, has threads 26 extending therearound. Also, a plurality of stops, teeth, or the like 27 are disposed about upper free end 25 of the spout 20 (see FIG. 3) each with a beveled surface 28 and a square edge 29, the purpose of which will be described hereinafter.

Closure 30 includes a top wall 32 which has a frustoconical, upwardly projecting member 33 located adjacent an edge of same. Upwardly projecting member 33 defines an opening 34 therethrough which can serve as a vent for container 10 or as a nozzle for squirt-dispensing or the like of the contents from within container 10. Also in a preferred construction, an annular sealing ring 32' is secured to an underside of top wall 32 and extends downwardly therefrom. Sealing ring 32' preferably resides within spout 20, making sealing contact with an inside wall of spout 20. Surrounding top wall 32 is skirt portion 35. Skirt portion 35 is secured to top wall 32, preferably of unitary construction therewith, and depends downwardly therefrom. Skirt portion 35 is adapted for removable securement to spout 20 about upper free end 25 to control dispensing of the contents of container 10. As illustrated in the Figures and as is preferred, threads 36 are located around inside wall 35' of skirt 35 (see FIG. 5) which will mate with threads 26 around end 25 of spout 20 (see FIG. 3).

A cap 37 is secured to closure 30, and preferably is integral therewith. Most preferably, cap 37 is of unitary construction with the other parts of closure 30, as by way of example, a living hinge type connection 38 with a portion of skirt 35. Cap 37 also has a tab 37' secured thereto on a side opposite hinge 38 to facilitate the opening of same. Cap 37 is thus movable about hinge connection 38 between an open position (FIG. 4) and a closed position (FIG. 5). Cap 37 includes a top 39 which defines a finger receiving opening 40 in a portion of same, with border portions 41 extending therearound. As illustrated in FIG. 5, border portions 41 extend downwardly to top wall 32 and when cap 37 is closed, in effect, cooperate with top wall 32 to define a recess thereat. An underside of wall 39 of cap 37 defines a depression 42 with a plug 43 located therewithin. Opening 42 is positioned to reside over frustoconical member 33 when cap 37 is closed. When so positioned, plug 43 seats in vent opening 34 and seals same. Frustoconical member 33 has a slight undercut around the base of same. When cap 37 is in the closed position, a snap fit relationship is thus produced between frustoconical member 33 and depression 42. The snap fit therebetween may also be replaced by a friction or interference fit, either of which can, be overcome by lifting on tab 37'.

Figure 4:
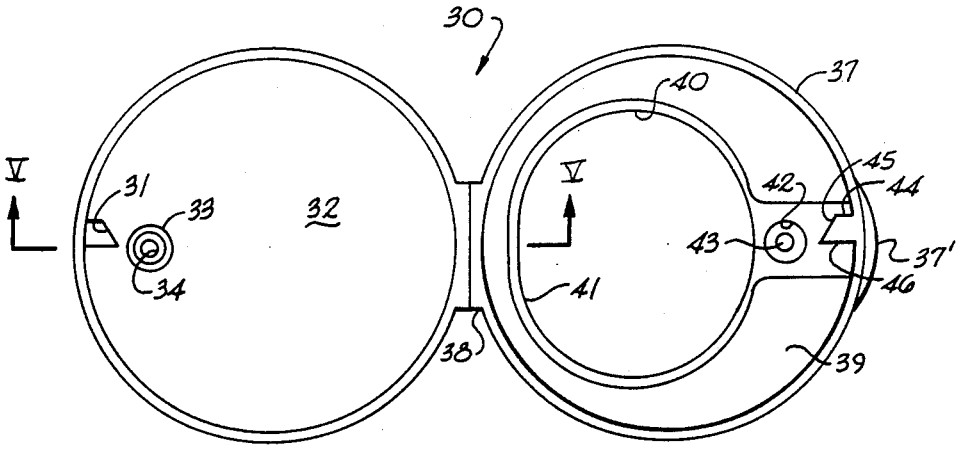
FIG. 4 is a top view of a closure according to the present invention with the cap in the open position.
Figure 5:
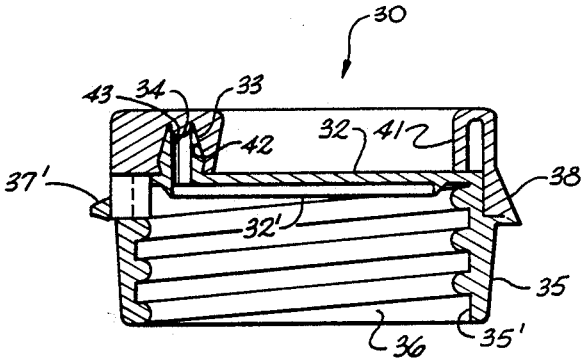
FIG. 5 is an elevational cross-sectional view of a closure according to the present invention as viewed along a line V—V of FIG. 4, but with the cap in the closed position.
Figure 6:
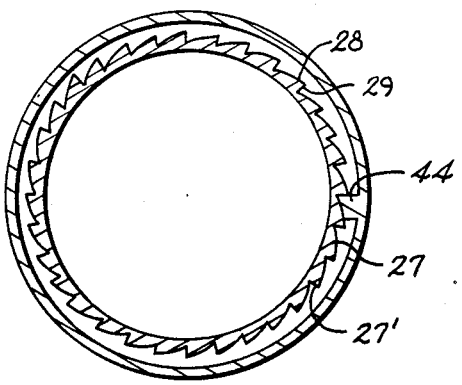
FIG. 6 is a top view of a container according to the present invention with a horizontal cross-sectional view of a closure according to the present invention on the container spout as viewed along a line VI—VI of FIG. 2.
Figure 7:
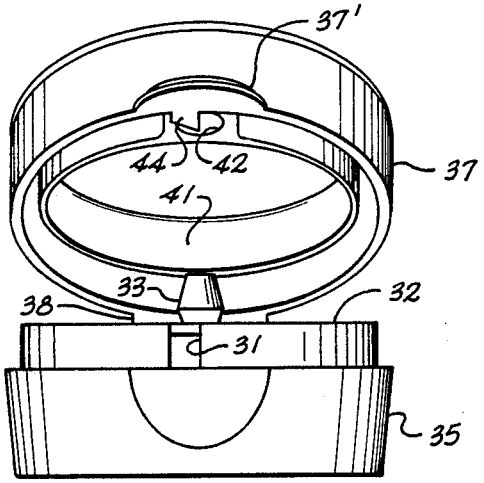
FIG. 7 is a perspective view of a closure according to the present invention with the cap partially open.

Top wall 32 of closure 30 defines an opening 31 therein adjacent an edge of same as illustrated in FIG. 4. Opening 31 is located on top wall 32 to reside outside of the inside diameter of end 25 of spout 20 and has a depth approximating the depth of the grooves 27' located between adjacent stops 27 around end 25. A pawl 44 is secured to an underside of cap top 39 and extends downwardly therefrom at a location to pass through opening 31 and beyond when cap 37 is closed. Pawl 44 would then reside in a groove 27' located between two adjacent stops 27. Preferably stops 27 have one beveled surface 28 and one straight surface or square edge 29, while pawl 44 has a beveled surface 45 that mates with stop beveled surfaces 28 and a straight side 46 that mates with stop straight sides 29. With such an arrangement, and with the beveled and straight sides properly oriented, closure 30 with cap 37 closed may be threaded onto spout 20 with the beveled surfaces overriding one another, but precluded from unthreading when the straight side or square edge 29 of a stop 27 encounters the straight side 46 of pawl 44. Hence as illustrated in FIG. 6, closure 30 may be turned in a clockwise direction only when cap 37 is closed. Thereafter, so long as cap 37 remains closed and pawl 44 is engaged by a stop 27, closure 30 cannot be unthreaded from spout 20 for filling or pouring of the contents from container 10.

Figure 8:
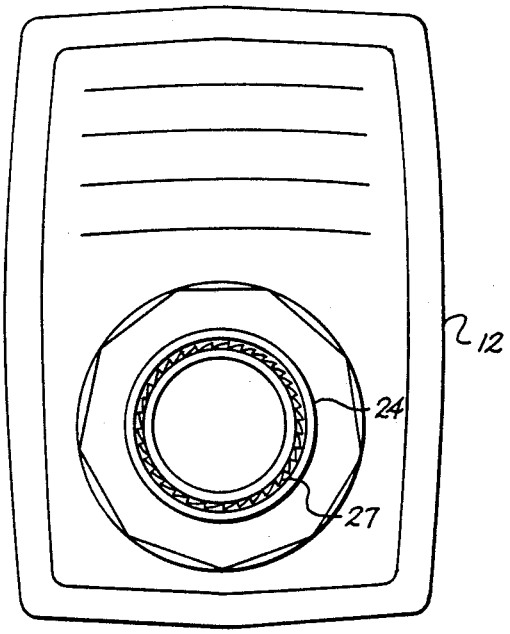
FIG. 8 is a top view of a container according to the present invention with the closure removed.

Instead of providing stops 27 as depicted in FIGS. 6 and 8, similarly shaped notches may be provided in threads 26 for like mating engagement with pawl 44.

To remove closure 30 from spout 20, cap 37 may be opened by lifting tab 37'. Pawl 44 is thereby retracted from contact with stops 27. Once the pawl 44 no longer contacts stops 27, closure 30 may be rotated in either direction relative to threaded portion 26 of spout 20 and may be entirely removed from spout 20.

Insofar as materials of construction are concerned for the container and parts thereof according to the teachings of the present invention, polymeric materials such as polyethylene and polypropylene may be used exclusively or in conjunction with metal. There are no critical limitations as to polymers other than that the composition should be inert to the contents of the container and should possess sufficient strength for the particular contents and sufficient flexibility in the pouring spout to permit collapse and withdrawal of the spout into and out of the container.

Having described the present invention in detail, it is obvious that one skilled in the art will be able to make modifications and adaption thereto without departing from the scope of the invention. Accordingly, the scope of the present invention should be determined by the claims appended hereto.

What is claimed is:

1. An improved closure for a dispensing container comprising a top wall, a skirt secured to said top wall and depending downwardly therefrom, said skirt being adapted to be removably securable to a portion of a container about which is to be received, said top wall defining a vent opening therein, a cap hingedly secured to a portion of said closure, said cap residing over said top wall in a closed position and being moveable about said hinge connection to an open position, said cap having means for closing said vent opening when in the closed position and having means thereon matable with a portion of said closure for removably locking said cap in the closed position, said closure further having means thereon matable with a portion of a container on which said closure is to be received when said cap is in the closed position only to preclude removal of said closure from said container.

2. A closure as defined in claim 1 wherein said skirt has threads located around an inside wall of same for mating with threads on the container to which the closure is to be secured.

3. A closure as defined in claim 1 wherein said top wall includes an upwardly projecting member and wherein said vent opening is located in said upwardly projecting member.

4. A closure as defined in claim 3 wherein said cap defines a recess therein for receipt of said upward projecting element when said cap is in the closed position.

5. A closure as defined in claim 1 wherein a portion of said cap defines an opening therein adapted to receive a human finger whereby when said cap is in the open position, a finger can be inserted into said opening for pulling on said closure.

6. A closure as defined in claim 5 wherein said portion of said cap defining said finger receiving opening extends downwardly with respect to an upper edge of said cap, and said means defining said vent opening comprises an upwardly projecting element, a portion of said cap defining said finger receiving opening being matable with said upwardly projecting element to releasably secure said cap in the closed position.

7. A closure as defined in claim 6 wherein said cap is of unitary construction with said closure by way of said hinge connection.

8. An improved closure for a dispensing container comprising a top wall, said top wall having an upwardly projecting member secured thereto and defining an opening therethrough, a skirt integral with said top wall and depending downwardly therefrom, an inside wall of said skirt being adapted for removable connection to a portion of a container with which said closure is to be employed, a cap integral with a portion of said closure and defining a hinge thereat about which said cap may be moved, said cap defining a recess portion adapted to be received over said upward projecting member from said top wall when in the closed position to close said opening and to mate with said upward projecting member for removable securement of said cap in the closed position, said cap further having means thereon that are matable with receiving means on said container portion to secure said closure against removal from said container portion only when said cap is in the closed position.

9. A closure as defined in claim 8 wherein said inside wall of said skirt has threads therearound for threaded connection with said container portion.

10. A closure as defined in claim 8 wherein said upwardly projecting member from said top wall has a generally frustoconical shape at an outer free end of same, and an undercut adjacent said top wall.

11. A closure as defined in claim 8 wherein said cap extends upwardly from said top wall and portions of same define a finger receiving opening and extend downwardly therewithin.

12. A closure as defined in claim 8 wherein said means for locking said closure against removal from said container portion comprises a pawl that extends downwardly from said cap.

13. An improved dispensing container comprising:

(a) side walls;

(b) a top wall secured to said side walls;

(c) a dispensing spout secured to said top wall; and (d) a closure removably secured to said spout at an outer free end of same, said closure comprising a top wall, said top wall defining a vent opening therethrough, said top wall having a skirt portion secured thereto and extending downwardly therefrom, an inside of said skirt portion being adapted for removable securement to said spout, and a cap secured to said closure about a hinge connection, said cap being movable about said hinge connection between an open position and a closed position, said cap having means thereon for closing said vent opening in said top wall when in the closed position, said cap further having means thereon for mating with receiving means on said spout when said cap is in the closed position for locking said closure against removal from said spout.

14. A container as defined in claim 13 wherein said outer free end of said spout is threaded and said inside wall of said skirt portion has threads therearound that mate with said threads on said spout.

15. An improved dispensing container comprising:

(a) side walls;

(b) a top wall secured to said side walls;

(c) a dispensing spout secured to said top wall; and (d) a closure threadably secured to said spout at an outer free end, said closure comprising a top wall, said top wall defining a vent opening therethrough, said top wall having a skirt portion secured thereto and extending downwardly therefrom, and a cap secured to said closure about a hinge connection, said cap being movable about said hinge connection between an open position and a closed position, said cap having means thereon for closing said vent opening in said top wall when in the closed position, said cap further having means thereon for mating with receiving means on said spout when said cap is in the closed position for locking said closure against removal from said spout.

16. A container as defined in claim 13 wherein at least one stop is provided on said spout and said means for locking said closure against removal from said spout comprises at least one element that extends downwardly from a portion of said cap, said downwardly extending element being engageable with said stop when said cap is in the closed position to preclude removal of said closure from said container.

17. A container as defined in claim 16 wherein a plurality of stops are provided around the perimeter of said spout, said downwardly extending element and said stops having beveled surfaces to permit passage of said downwardly extending element thereby in one direction of rotation and straight edges in an opposite to preclude passage of said downwardly extending element in an opposite direction of rotation, whereby said closure may be threaded onto said spout when said cap is closed, but engagement between said downwardly extending element and one of said stops precludes unthreading.

18. A container as defined in claim 17 wherein said cap defines a finger receiving opening therein.

19. An improved dispensing container comprising:

(a) side walls;

(b) a top wall of unitary construction with said side walls;

(c) a dispensing spout of unitary construction with said top wall, said spout having a bellows section along a lower portion of same whereby said spout is movable about said bellows section between a collapsed position in which a portion of said spout moves within said bellows section and said bellows section turns on itself and an extended position; said spout having threads therearound adjacent an outer free end and having at least one stop member adjacent an outer free end; and (d) a closure for said spout, said closure having a threaded skirt portion matable with threads around said spout and a cap hingedly secured to said skirt and movable about said hinge connection between an open and closed position, said cap having means thereon matable with a portion of said skirt for releasable securement therebetween, said cap having a locking member secured to same and extending downwardly therefrom, said locking member being engageable with said at least one stop member on said spout when said cap is closed to prevent removal of said closure from the spout.

20. An improved container as defined in claim 19 wherein said spout has a plurality of stop members therearound, said stop members and said locking member having beveled surfaces on one side and a square edge on an opposite side.

21. An improved container as defined in claim 20 wherein said closure further has a top wall, said top wall defining an opening therein and being located beneath said cap when said cap is closed.

22. A closure for a container, comprising a skirt portion, said skirt portion having threads around an inside wall of same, and a cap hinged to said skirt portion, said cap and said skirt portion having matable means thereon for releasable securement of said cap in the closed position, said cap further having locking means thereon and depending therefrom for locking engagement with means on said container only when said cap is closed to lock said closure on said container.

23. An improved closure for a dispensing container comprising a top wall, a skirt secured to said top wall and depending downwardly therefrom, said skirt having threads located around an inside wall of same for mating with threads on a container to which the closure is to be secured, said top wall defining a vent opening therein, a cap hingedly secured to a portion of said closure, said cap residing over said top wall in a closed position and being movable about said hinge connection to an open position, said cap having means for closing said vent opening when in the closed position and having means thereon matable with a portion of said closure for removably locking said cap in the closed position, said cap further having a member secured thereto and extending downwardly therefrom for locking engagement with elements on said container on which said closure is to be received when said cap is in the closed position only whereby said closure cannot be unthreaded from said container when said cap is in the closed position.

24. A closure as defined in claim 23 wherein said locking member extending downwardly from said cap is a pawl having a beveled edge and a straight edge whereby said pawl will override said elements on said container during rotation for threading said closure onto said container and will lockingly engage one of said elements during reverse rotation to preclude removal of said closure.

25. An improved closure for a dispensing container comprising a top wall, said top wall having an upwardly projecting member secured thereto and defining an opening therethrough, a skirt integral with said top wall and depending downwardly therefrom, an inside wall of said skirt being adapted for removable connection to a portion of a container with which said closure is to be employed, a cap integral with a portion of said closure and defining a hinge thereat about which said cap may be moved, said cap defining a recessed portion adapted to be received over said upward projecting member from said top wall when in the closed position to close said opening and to mate with said element for removable securement of said cap in the closed position, said cap further having a pawl that extends downwardly therefrom that is matable with means on said container to secure said closure against removal from said container when said cap is in the closed position.

* * * * *